US005829958A

United States Patent [19]

von Hollen

[11] Patent Number: 5,829,958

[45] Date of Patent: Nov. 3, 1998

[54] PUMPING UNIT WITH SPEED REDUCING MEANS

[75] Inventor: David G. von Hollen, Odessa, Tex.

[73] Assignee: BeauTech, Inc., Perryton, Tex.

[21] Appl. No.: 805,235

[22] Filed: Feb. 24, 1997

[51] Int. Cl.[6] ..... F04B 17/00

[52] U.S. Cl. ..... 417/362; 74/41

[58] Field of Search ..... 417/362, 415; 74/41, 89.22

[56] References Cited

U.S. PATENT DOCUMENTS

| | | | |
|---|---|---|---|
| 4,238,966 | 12/1980 | Carlson et al. | 74/41 |
| 4,445,823 | 5/1984 | Zyduck | 417/430 |
| 4,454,778 | 6/1984 | Camren | 74/41 |
| 4,461,187 | 7/1984 | Stanton | 74/41 |
| 4,492,126 | 1/1985 | Davis | 74/41 |
| 4,743,172 | 5/1988 | Watson | 417/362 |
| 4,834,620 | 5/1989 | Sweeney | 417/233 |
| 4,997,346 | 3/1991 | Bohon | 417/362 |

*Primary Examiner*—Timothy Thorpe
*Assistant Examiner*—Peter G. Korytnyk
*Attorney, Agent, or Firm*—Bill B. Berryhill

[57] ABSTRACT

A pumping unit comprising a supporting post and a walking beam, having a head end and a tail end, pivotally connected to the post to allow for rocking of the beam about a horizontal pivot axis. The head end is connected to a vertical pump rod. The walking beam is also connected to one end of an arm, the opposite end of which is connected to a drive assembly for rocking of the beam about the horizontal pivot axis to reciprocate and produce a predetermined number of up and down strokes per minute of the pump rod. The drive assembly includes a rotating power device connected by sheaves and belts a transmission assembly whereby rotation of the power device is translated to a longitudinal force on the arm for rocking of the beam. The drive assembly is further characterized by a speed reducer interpositionable between the power device and the power transmission assembly to substantially reduce the number of up and down strokes per minute of the pump rod.

4 Claims, 3 Drawing Sheets

PUMPING UNIT WITH SPEED REDUCING MEANS

BACKGROUND OF THE INVENTION

1. Field of the Invention.

The present invention pertains to pumping units of the type utilized in the oil and/or gas industry. More specifically, the present invention pertains to heavy duty pumping units, sometimes referred to as "pump jacks" by which a reciprocating pump, located downhole in a well, is operated from a location at the surface of the well.

2. Description of the Prior Art.

"Pump jacks" are typically utilized at the surface of an oil well to reciprocate lift pumps, located downhole in the well, for lifting subsurface fluids to the surface of the well. A lift pump usually includes a tubular barrel and a cooperating plunger assembly which reciprocates therein. The plunger assembly may be attached to a rod which extends to the surface of the well and by which the plunger assembly may be reciprocated by a pump jack.

Pump jacks or pumping units are located at the surface of the well to reciprocate the rod to which the lift valve is attached. A typical pump jack may comprise a supporting post and a walking beam, having a head end and a tail end, pivotally connected to the post to allow for rocking of the beam about a horizontal pivot axis between positions in which the head end is up and the tail end is down and positions in which the head end is down and the tail end is up. The head end is connected to the upper end of a vertical pump rod at the lower end of which is the lift pump. The walking beam is typically connected to one end of an arm, the opposite end of which connected to a drive assembly, to rock the beam about its horizontal pivot axis to reciprocate and produce a predetermined number and rate of up and down strokes of the pump rod. The drive assembly may include a rotating power device, such as an electric motor, connected by sheaves and belts to a power transmission assembly, e.g. a gear box, whereby rotation of the power device is translated to a longitudinal force on the arm for rocking of the beam. Examples of such pump jacks may be seen in the following U.S. Pat. Nos. 4,238,966; 4,454,778; 4,492,126; 4,723,452 and 4,743,172.

Such pump jacks or pumping units have been typically engineered in the past for strokes as slow as 6 strokes per minute and as fast as 14 strokes per minute, depending upon available production, the pump length or stroke and pump size. This approach works well until production is substantially decreased, resulting in low pumping efficiencies. As production decreases, the pump barrel will not fill completely, being only partially filled during a full stroke. The typical method of compensating for low production in the past has been to shorten the stroke, downsize the pump and remain at a constant strokes per minute, somewhere around 10 strokes per minute. Several problems are created in this manner of compensating for low production. Rods may buckle or part on the downstroke, more friction is created between the rods and the tubing, resulting in tubing failure. Cyclic loading and unloading of the unit 10 times per minute creates greater surface equipment failure, etc. Fluid across the standing valve of the lift pump may be depressurized, resulting in gas breakout into the pump, gas lock and improper pump lubrication, resulting in pump failure. When gas lock occurs, produced sand may fall into the pump. Thus, a more creative and efficient way of compensating for decreasing production is needed.

SUMMARY OF THE PRESENT INVENTION

The present invention utilizes a pumping unit or pump jack which is some respects is similar to the prior art. For example, the pumping unit may include a supporting post and a walking beam, having a head end and a tail end, pivotally connected to the post to allow for rocking of the beam about a horizontal pivot axis between positions in which the head end is up and positions in which the head end is down. The head end of the walking beam is connected to a vertical pump rod at the lower end of which is connected a lift pump of any desired design. The walking beam may also be connected to one end of an arm the opposite end of which is connected to the gearbox of a drive assembly for rocking of the beam about its horizontal pivot axis and to reciprocate and produce a predetermined number of up and down strokes per minute of the pump rod. In addition to the gearbox, the drive assembly, as in the prior art, includes a power device such as an electric motor which is connected to the gear box by sheaves and belts. This arrangement is typical of the prior art and is all that is required during normal production.

When production decreases, the pumping unit of the present invention is provided with speed reducing means which is interpositionable between the power device and the gearbox to slow rotation of the gearbox output and to reduce the number of up and down strokes per minute of the pump rod. For example, the pumping unit may be initially designed for 10 strokes per minute. When production decreases, the speed reducing means may be installed to reduce the strokes to 5 strokes per minute.

The speed reducing means of the present invention is unique and includes a tubular housing at each end of which is carried bearing assemblies. The bearing assemblies concentrically support a shaft within the housing, one end of which projects out of the housing. A seal assembly is carried by the tubular housing for sealing engagement with the shaft, sealing around the shaft and sealing the interior of the tubular housing which is filled with lubricating fluid. A sheave assembly is attached to the projecting end of a shaft and includes at least one sheave for engagement by a belt attached to the power device and a substantially smaller sheave for engagement by a belt connected to the gearbox. The tubular housing of the speed reducing means is uniquely mounted on a pivotal mounting which allows the shaft and the sheave assembly to be self-centering between the power device and the gearbox.

As indicated, the unique speed reducing assembly of the present invention makes available an extra mechanical speed reduction not previously available. The number of strokes per minute of the pump rod and pump are substantially reduced and the power required for operating the power device may be substantially reduced. More importantly, as the unit is slowed, many advantages are realized. The pump plunger is allowed time to sink into the fluid. Rod parting and tubing failures are substantially reduced. Cyclic loading declines and there is less outbreak of gas in the pump and less likelihood of gas lock. Many other objects and advantages of the invention will be apparent from reading the description which follows in conjunction with the accompanying drawings.

DESCRIPTION OF A PREFERRED EMBODIMENT

Figure 1:
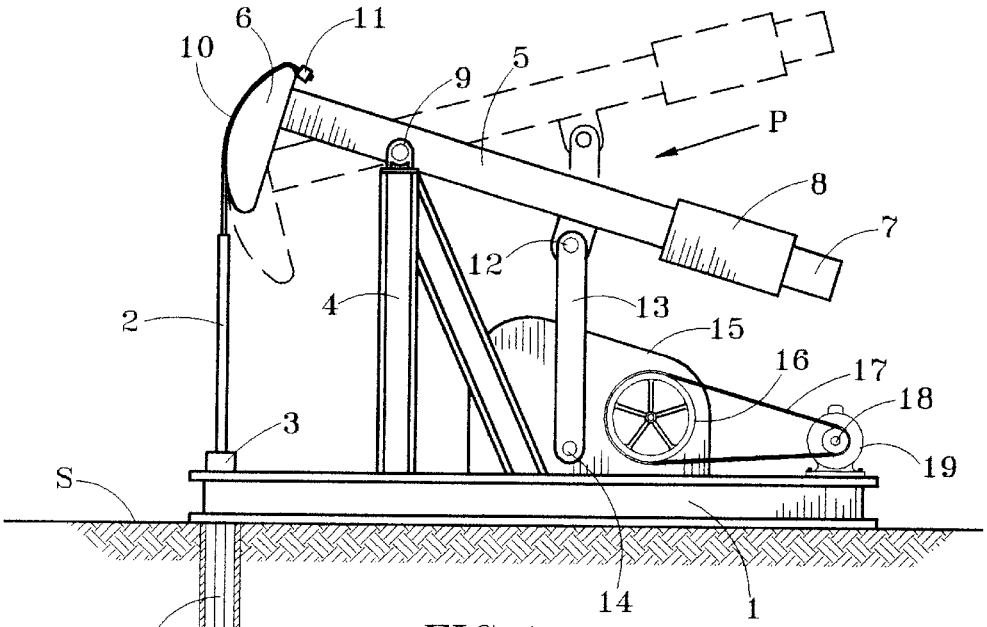
FIG. 1 (PRIOR ART)
FIG. 1 is a typical elevation view of a pump jack being utilized to reciprocate the pump rod in an oil well.

Referring first to FIG. 1 there is shown a pumping unit or pump jack P supported on a base 1 at the surface S of an oil well W in which is disposed a lift pump (not shown) attached to a reciprocating pump rod 2. The pump rod 2 projects upwardly through a well head 3 for connection to the pump jack P. The pump jack P may comprise a supporting post 4 and a walking beam 5 having a head end 6 and a tail end 7. Typically a counterweight 8 of some type is mounted near the tail end of the walking beam 5. The walking beam 5 is pivotally attached to the post 4 by pivot connection 9 of some type to allow for rocking of the beam 5 about a horizontal pivot axis between positions in which the head end 6 is up and the tail end 7 is down and positions in which the head end is down and the tail end is up (see dotted lines). The pump rod 2 is connected by cable 10 or the like by a connector 11 to the head end of the walking beam 5. Thus, rocking of the walking beam 5 causes the pump rod 2 to reciprocate up and down.

The walking beam 5 is also connected by another pivot connection 12 to an arm member 13 which is in turn connected by another pivot connection 14 of some type to the output of a gearbox or power transmission assembly 15. Input to the gearbox or power transmission assembly is provided by a large sheave 16 connected by one or more belts 17 to one or more sheaves 18 attached to the shaft of a power device such as an electric motor 19.

Referring now to FIG's 2 and 3, the pump rod 2 extends downwardly into the well W where it is connected to a lift pump 20. A lift pump typically includes a lower standing valve 21 and pump barrel 23 and an upper traveling valve 22 which is fixed to a reciprocating plunger assembly 24 of the pump 20. The standing valve 21 and traveling valve 22, act as check valves, opening and closing opposite of each other, on upstrokes and downstrokes of the plunger assembly. While it is not necessary to understand all the details of a lift pump, a general understanding of lift pumps may be gained by reviewing U.S. Pat. No. 5,178,184. As the plunger assembly and attached traveling valve 22 are lowered on a downstroke, standing valve 21 is closed blocking reverse fluid flow therethrough and the traveling valve 22 is open allowing fluid within the pump barrel 23 to be displaced through the traveling valve 22 into the tubing thereabove. On the subsequent upstroke, the traveling valve 22 closes, lifting fluids thereabove towards the surface of the well W. Since the pressure in the pump barrel 23 below the traveling valve 22 decreases during the upstroke, the standing valve 21 then opens allowing fluid to flow into the pump barrel 23 from the producing formation for a succeeding downstroke. As this process continues, fluid flows through the standing valve 21 and into the barrel 23 on upstrokes and through the traveling valve 22 toward the surface of the well W on the downstrokes.

Figure 2:
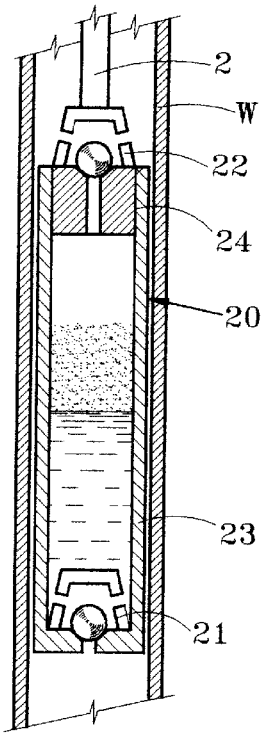
FIG. 2 is a longitudinal view, in section, of a downhole lift pump illustrating the problem of reduced production.
Figure 3:
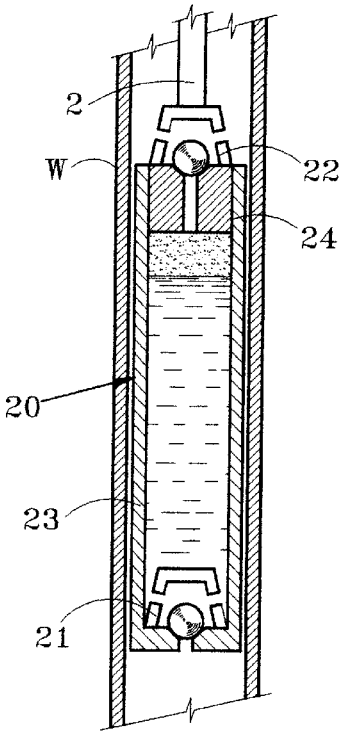
FIG. 3 is a longitudinal view, in section, of the lift pump of FIG. 2 illustrating its operation at reduced strokes.

As previously mentioned, pumping units have been typically engineered for strokes of 6 to 14 strokes per minute, depending upon available production, pump length or stroke and pump size. With normal production, the pump barrel completely fills, as illustrated in FIG. 3, during an upstroke and is emptied in the succeeding downstroke. However, as production decreases, the pump barrel 23 will not fill completely, being only partially filled, as indicated in FIG. 2, during a full stroke. As previously indicated, the solution to this problem in the past was to shorten the stroke, downsize the pump and remain at a constant stroke per minute, typically 10 strokes per minute. However, this may result in rods buckling or parting on the downstroke and creation of more friction between the rods and the tubing, resulting in tubing failure. Cyclic loading and unloading of the unit 10 times per minute may result in greater surface equipment failure. Fluid across the standing valve may be depressurized resulting in gas breakout into the pump, gas lock and improper pump lubrication, resulting in pump failure. If gas lock occurs, producing sand may fall into the pump.

Figure 4:
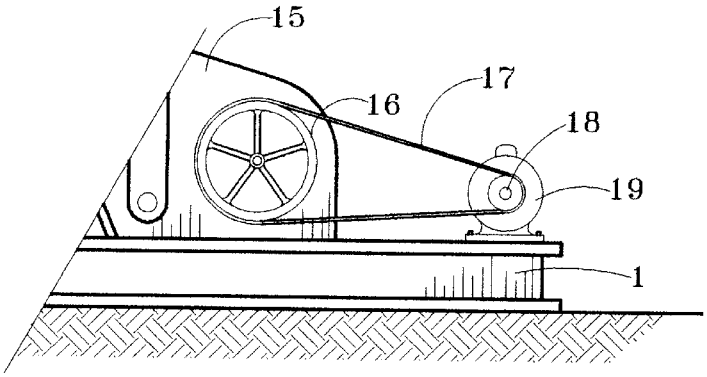
FIG.4 (PRIOR ART)
FIG. 4 is a partial elevation view of the pump jack of FIG. 1 illustrating a portion of a gearbox or power transmission assembly thereof and its connection with a power device such as an electric motor as in the prior art.

With the solutions of the prior art, the number of strokes per minute of the rod remain the same even though the length of the stroke is reduced, due to the fact that the power train, as illustrated in FIG. 4, remains the same, the gearbox or power transmission assembly 15 being driven by sheave 16 connected by belts 17 to the sheave 18 of power device 19.

In the typical illustrated embodiment of FIG. 4, the sheave 18 attached to the motor 19 is 6" in diameter. The sheave 16 of the gearbox being driven by belt 17 is a 48" sheave. To drive such a unit would require approximately twenty horsepower capability with 100 lbs of torque at 10 strokes per minute.

The present invention solves the problems of decreased production by slowing the pumping so that the pump barrel 23 of the lift pump 20 will completely fill as illustrated in FIG. 3, eliminating the problems associated with a partially filled barrel 23 of FIG. 2. As the pumping is slowed, many advantages are realized. The plunger 24 will have time to sink into the fluid. Rod parting and tubing failures are substantially reduced. Cyclic loading declines and there is less outbreak of gas in the pump and less likelihood of gas lock.

Figure 5:
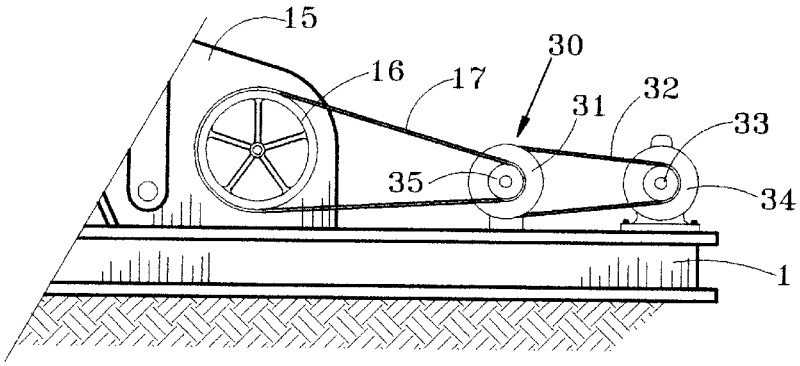
FIG. 5 is a partial elevation view illustrating a portion of a similar gearbox and power device but interposed between which is a speed reducing assembly, according to a preferred embodiment of the invention.
Figure 6:
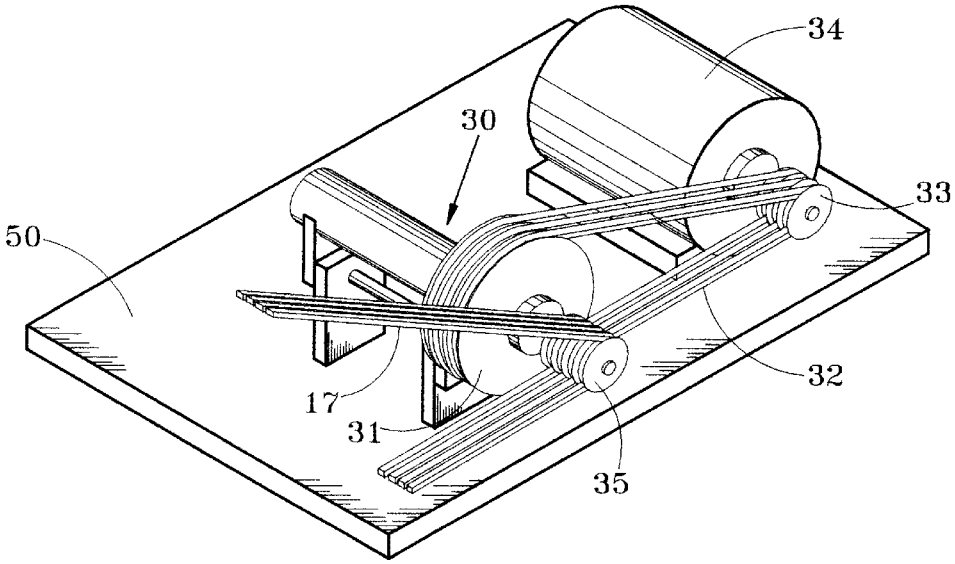
FIG. 6 is an isometric view illustrating in greater detail the speed reducing assembly of FIG. 5 interposed between the power device and power transmission assembly.
Figure 7:
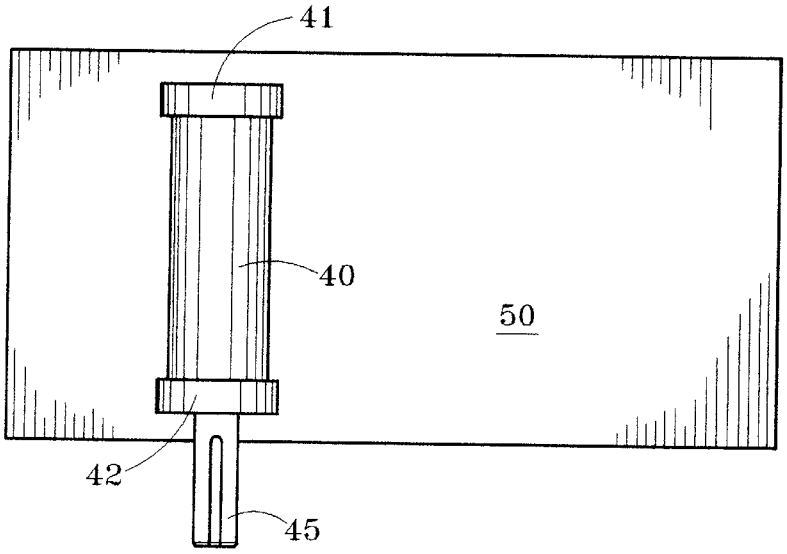
FIG. 7 is a top plan view of the speed reducing assembly of FIG. 6.
Figure 8:
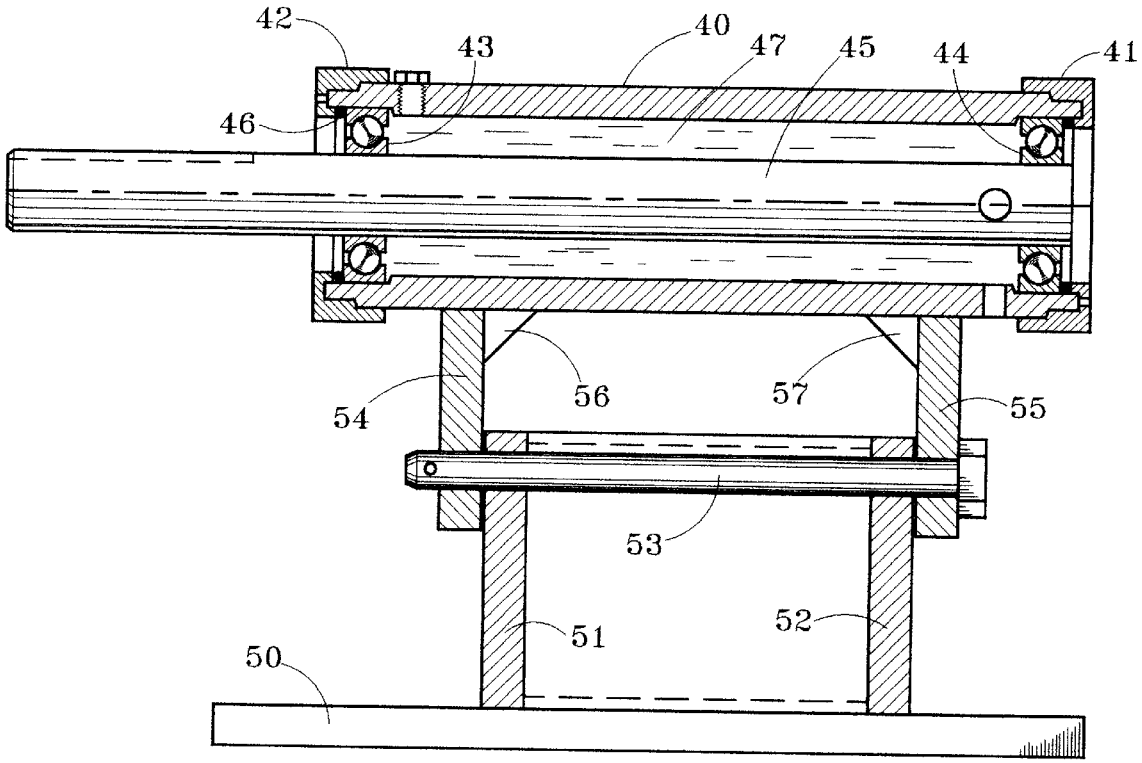
FIG. 8 is an elevation view of the speed reducing assembly of FIG. 6 and 7 taken along the lines of 8—8 of FIG. 7.

In the present invention, as illustrated in FIG. 5, a speed reduction unit is interpositionable between the power device, e.g. electric motor 31, and the power transmission assembly or gearbox 15. The speed reduction assembly 30 includes one or more sheaves 31 for engagement by one or more belts 32 attached to the sheave 33 of power device 34, e.g. an electric motor. One or more substantially smaller sheaves 35 are provided for engagement by the belt 17 connected to the large sheave 16 of the power transmission assembly 15.

The speed reducing assembly 30, best seen in FIG's 6, 7 and 8, includes a tubular housing 40 closed at both ends by sealed end caps 41 and 42. Supported within the tubular housing 40 are first and second bearing assemblies 43, 44. A shaft 45 is concentrically disposed in the tubular housing 40 and supported at opposite ends thereof by the first and second bearing assemblies 43, 44. One end of the shaft 45 projects out of the housing. A seal assembly 46 carried by the tubular housing 40 sealingly engages the shaft at the point where it projects out of the housing 40 and the tubular housing is sealed and filled with lubricating fluids 47.

In the exemplary embodiment, there are two sizes of sheaves, a larger sheave 31 for engagement by one or more belt 32 attached to the electric motor 34 and a substantially smaller sheave 35 for engagement by one or more belts 17 connected to the power transmission assembly 15. The sheaves may be provided with grooves for multiple belts. For example, sheave 31 provides for three belts and sheave 35 provides for four belts in the exemplary embodiment.

The speed reducing assembly 30 may be mounted on a base plate 50 by a pivoting type of mounting. In the exemplary embodiment, there are a pair of spaced apart first and second stationary supports 51, 52. A horizontal rod 53 is supported at each end thereof by the supports 51, 52. First and second connectors 54, 55 may extend radially from the tubular housing 40 and are provided with coaxially aligned holes for rotating engagement with the horizontal rod 53. Reinforcing members 56 and 57 may be welded to the connectors 54, 55 and the tubular housing 40. This type of pivoting arrangement allows limited pivotal movement of the tubular housing about the axis of the rod member 53 and allows the speed reduction assembly 30 and the sheaves 31, 35 thereof to be self-centering between the power device 34 and the power transmission assembly 15.

Utilizing the speed reducing assembly of the present invention, an extra mechanical speed reduction not previously available is provided. Thus the number of strokes per minute can be reduced from 10 strokes per minute to less than 6 strokes per minute. For example, in FIG. 5, the motor 34 is illustrated as one with a 9" sheave 33 which is attached to an 18" sheave 31 of the speed reducing assembly 30. A 6" sheave 35 attached to the speed reducing assembly shaft 45 is then attached to the 48" sheave 16 of the gearbox power transmission assembly 15. With this arrangement, the strokes are reduced from 10 strokes per minute to approximately 5 strokes per minute and the electric current required by the motor 34 is reduced by approximately two-thirds.

Thus, the pumping unit of the present invention is provided with a speed reduction assembly which substantially reduces the strokes per minute of a pump rod allowing the lift pump to be totally filled and eliminating the problems associated with a partially filled pump previously discussed. Pumping is much more efficient and all of these problems are eliminated by the installation and interpositioning of a relatively inexpensive but effective speed reduction assembly.

A single embodiment of the invention has been described herein. However, many variations thereof may be made without departing from the spirit of the invention. Accordingly, it is intended that the scope of the invention be limited only by the claims which follow.

I claim:

1. A pumping unit comprising a supporting post and a walking beam, having a head end and a tail end, pivotally connected to said post to allow for rocking of said beam about a horizontal pivot axis between positions in which said head end is up and said tail end is down and positions in which said head end is down and said tail end is up, said head end being connected to a vertical pump rod, the lower end of which is connected to a lift pump disposed near the bottom of a well, said walking beam also being connected to one end of an arm, the opposite end of which is connected to a drive assembly for rocking of said beam about said horizontal pivot axis to reciprocate and produce a predetermined number of up and down strokes per minute of said pump rod, said drive assembly including rotating power means connected by sheaves and belts to transmission means whereby rotation of said power means is translated to a longitudinal force on said arm for said rocking of said beam, said drive assembly being further characterized by speed reducing means interpositionable between said power means and said power transmission means to substantially reduce the number of up and down strokes per minute of said pump rod; said speed reducing means comprising:

a tubular housing:

first and second bearing assemblies carried at each end of said housing:

a shaft concentrically disposed in said housing and supported for rotation therein by said first and second bearing assemblies, one end of said shaft projecting out of said housing; and sheave means attached to said projecting end of said shaft, said sheave means including at least one sheave for engagement by a belt attached to said power means and a substantially smaller sheave for engagement by a belt connected to said power transmission means.

2. The pumping unit of claim 1 in which said speed reducing means includes seal means carried by said tubular housing and sealingly engaging said shaft at the point where said shaft projects out of said housing, said tubular housing being sealed and filled with lubricating fluids.

3. The pumping unit of claim 1 in which said speed reducing means includes mounting means to which said tubular housing is pivotally attached for limited pivoting movement about an axis which is parallel to the central axis of said tubular housing, allowing said shaft and said sheave means to be self-centering between said power means and said power transmission means.

4. The pumping unit of claim 3 in which said mounting means comprises first and second spaced apart stationary supports, a horizontal rod, each end of which is supported by one of said first and second supports, and first and second connectors radially projecting from said tubular housing, each of said connectors rotatingly engaging said horizontal rod to permit said limited pivotal movement of said tubular housing about said axis which corresponds with the central axis of said rod.

* * * * *